US007510473B2

(12) United States Patent
Thomas

(10) Patent No.: US 7,510,473 B2
(45) Date of Patent: Mar. 31, 2009

(54) WAGERING GAME HAVING PROGRESSIVE AMOUNTS REPRESENTED IN VARIOUS WAYS

(75) Inventor: Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 589 days.

(21) Appl. No.: 10/881,285

(22) Filed: Jun. 30, 2004

(65) Prior Publication Data

US 2006/0003829 A1 Jan. 5, 2006

(51) Int. Cl.
*G07F 17/32* (2006.01)

(52) U.S. Cl. ..... 463/25; 463/31; 463/27

(58) Field of Classification Search ..... 463/27, 463/30–33, 36, 37, 40–42, 20, 25
See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,861,041 | A | 8/1989 | Jones et al. | 273/292 |
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt et al. | 463/12 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell, II | 273/85 CP |
| 5,417,430 | A | 5/1995 | Breeding | 273/292 |
| 5,524,888 | A | 6/1996 | Heidel | 463/22 |
| 5,544,892 | A | 8/1996 | Breeding | 273/292 |
| 5,564,700 | A | 10/1996 | Celona | 463/27 |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,611,730 | A | 3/1997 | Weiss | 463/20 |
| 5,645,486 | A | 7/1997 | Nagao et al. | 463/27 |
| 5,647,592 | A | 7/1997 | Gerow | 463/139 |

(Continued)

FOREIGN PATENT DOCUMENTS

| | | |
|---|---|---|
| CA | 2 334 546 | 8/2001 |

(Continued)

OTHER PUBLICATIONS

Spotlight, Flip Flop Anchor Gaming, '00 Games (Jun. 2000).

(Continued)

*Primary Examiner*—John M Hotaling, II
*Assistant Examiner*—Masud Ahmed
(74) *Attorney, Agent, or Firm*—Nixon Peabody LLP

(57) ABSTRACT

A gaming terminal for playing a wagering game includes a player-input device, a display, and a progressive display region. The wagering game includes at least one progressive jackpot that is funded by a portion of a wager input received in a player-input device. In response to receiving the wager input the display shows at least one randomly-selected outcome of a plurality of outcomes. The progressive display region includes a dynamic representation of the progressive jackpot, wherein the size of the dynamic representation changes in real-time according to changes occurring in the progressive jackpot.

18 Claims, 12 Drawing Sheets

U.S. PATENT DOCUMENTS

| | | | | |
|---|---|---|---|---|
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,839,956 | A | 11/1998 | Takemoto | 463/25 |
| 5,848,932 | A | 12/1998 | Adams | 463/20 |
| 5,851,147 | A | 12/1998 | Stupak | 463/13 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 6,003,013 | A | 12/1999 | Boushy et al. | 705/10 |
| 6,007,427 | A | 12/1999 | Wiener et al. | 463/17 |
| 6,012,982 | A | 1/2000 | Piechowiak et al. | 463/16 |
| 6,032,955 | A | 3/2000 | Luciano et al. | 273/138.1 |
| 6,047,963 | A | 4/2000 | Pierce et al. | 273/121 B |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A * | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,241,608 | B1 | 6/2001 | Torango | 463/27 |
| 6,254,481 | B1 | 7/2001 | Jaffe | 463/20 |
| 6,254,483 | B1 | 7/2001 | Acres | 463/26 |
| 6,287,194 | B1 * | 9/2001 | Okada et al. | 463/16 |
| 6,312,332 | B1 | 11/2001 | Walker et al. | 463/23 |
| 6,315,660 | B1 | 11/2001 | DeMar et al. | 463/16 |
| 6,315,666 | B1 * | 11/2001 | Mastera et al. | 463/31 |
| 6,319,125 | B1 | 11/2001 | Acres | 463/25 |
| 6,319,127 | B1 | 11/2001 | Walker et al. | 463/26 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,347,996 | B1 | 2/2002 | Gilmore et al. | 463/17 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,569,018 | B2 * | 5/2003 | Jaffe | 463/30 |
| 6,577,733 | B1 | 6/2003 | Charrin | 380/251 |
| 6,589,115 | B2 | 7/2003 | Walker et al. | 463/25 |
| 6,592,458 | B1 | 7/2003 | Ho | 463/17 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,648,762 | B2 | 11/2003 | Walker et al. | 463/25 |
| 6,656,052 | B2 | 12/2003 | Abramopoulos et al. | 463/47 |
| 6,676,513 | B2 | 1/2004 | Gauselmann | 463/20 |
| 6,712,695 | B2 | 3/2004 | Mothwurf et al. | 463/25 |
| 6,733,390 | B2 | 5/2004 | Walker et al. | 463/23 |
| 6,776,715 | B2 | 8/2004 | Price | 463/27 |
| 6,796,901 | B2 * | 9/2004 | Baerlocher | 463/16 |
| 6,887,154 | B1 | 5/2005 | Luciano, Jr. et al. | 463/26 |
| 7,004,466 | B2 | 2/2006 | Gauselmann | 463/138 |
| 7,036,012 | B2 | 4/2006 | Charrin | 713/169 |
| 7,056,215 | B1 | 6/2006 | Olive | 463/27 |
| 7,121,945 | B2 * | 10/2006 | Suganuma et al. | 463/34 |
| 7,137,887 | B2 * | 11/2006 | Gomez et al. | 463/20 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0014370 | A1 | 1/2003 | Charrin | 705/65 |
| 2003/0027618 | A1 | 2/2003 | Byrne | 463/16 |
| 2003/0027625 | A1 | 2/2003 | Rowe | 463/20 |
| 2003/0032479 | A1 | 2/2003 | LeMay et al. | 463/32 |
| 2003/0036430 | A1 | 2/2003 | Cannon | 463/42 |
| 2003/0045337 | A1 | 3/2003 | Byrne | 463/16 |
| 2003/0050106 | A1 | 3/2003 | Lyfoung | 463/13 |
| 2003/0060266 | A1 | 3/2003 | Baerlocher | 463/20 |
| 2003/0064776 | A1 | 4/2003 | Byrne | 463/16 |
| 2003/0109306 | A1 | 6/2003 | Karmarkar | 463/40 |
| 2003/0148807 | A1 | 8/2003 | Acres | 463/40 |
| 2003/0148808 | A1 | 8/2003 | Price | 463/27 |
| 2003/0181231 | A1 | 9/2003 | Vancura et al. | 463/9 |
| 2003/0186733 | A1 | 10/2003 | Wolf et al. | 463/16 |
| 2003/0211884 | A1 | 11/2003 | Gauselmann | 463/20 |
| 2003/0216166 | A1 | 11/2003 | Baerlocher et al. | 463/20 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0023716 | A1 | 2/2004 | Gauselmann | 463/23 |
| 2004/0038741 | A1 | 2/2004 | Gauselmann | 463/42 |
| 2004/0048644 | A1 | 3/2004 | Gerrard et al. | 463/16 |
| 2004/0053686 | A1 | 3/2004 | Pacey et al. | 463/25 |
| 2004/0092304 | A1 | 5/2004 | George | 463/29 |
| 2005/0003880 | A1 * | 1/2005 | Englman et al. | 463/16 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0096130 | A1 | 5/2005 | Mullins | 463/27 |
| 2005/0137010 | A1 | 6/2005 | Enzminger et al. | 463/25 |
| 2005/0192088 | A1 | 9/2005 | Hartman et al. | 463/27 |
| 2005/0197181 | A1 * | 9/2005 | Jaffe | 463/20 |
| 2005/0215313 | A1 | 9/2005 | O'Halloran | 463/26 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0052159 | A1 | 3/2006 | Cahill et al. | 463/27 |
| 2006/0073887 | A1 | 4/2006 | Rodgers et al. | 463/20 |
| 2006/0073889 | A1 | 4/2006 | Edidin et al. | 463/27 |
| 2006/0116201 | A1 | 6/2006 | Gausselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |

| | | | | |
|---|---|---|---|---|
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |

OTHER PUBLICATIONS

Star Wars Video Slots, '03 Games (Sep. 2003).
Article for "Easy Riches" by Sigma Game, Strictly Slots, 1 page (Aug. 2001).
Article for "Millioniser" by Glenn Haussman, Strictly Slots, pp. 50-53, 4 pages (Mar. 2004).
Product Sheet for "Big Games Safari," IGT, 24 pages (2000).
"New '97 Games," International Gaming & Wagering Business, 24 pages (Mar. 1997).

* cited by examiner

WAGERING GAME HAVING PROGRESSIVE AMOUNTS REPRESENTED IN VARIOUS WAYS

FIELD OF THE INVENTION

The present invention relates generally to gaming terminals for playing a wagering game and, more particularly, to a gaming terminal displaying different ways of representing a progressive amount.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive jackpot. In the gaming industry, a "progressive" game involves collecting coin-in data from participating gaming device(s) (e.g., slot machines), contributing a percentage of that coin-in data to a jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement. In existing progressive jackpots, the progressives are often high-pay, low-frequency progressives, which may result in some players becoming disheartened when they do not win.

Current progressive games fail to provide real-time representations of progressive amounts that visually stimulate a player's anticipation to provide a more pleasurable and entertaining gaming experience. Some current representations of progressive amounts are generally shown as static images, e.g., a bag of money having a fixed size. Although the progressive amount may increase or decrease during a particular time period, the size of the image does not change. A problem with this type of representations is that it tends to provide an uneventful gaming experience. Also, it can be difficult for some players to read that actual amount of the progressive jackpot.

Another problem with some current progressive games is that real-time information regarding the most current progressive amounts is not readily available to the player. For example, a type of progressive games displays a pre-rendered image, which represents the progressive jackpot, that updates only at predetermined intervals. Thus, there are time periods during which the player is unaware of any changes that might have occurred to the progressive jackpot. Depending on the size of the progressive amount at a particular time, the player may choose to play for a high-pay, low-frequency, progressive jackpot or for a low-pay, high-frequency, progressive jackpot. However, because the player is not readily aware of the latest changes in the progressive amounts, the player might get frustrated with the game if an uninformed decision results in a loss. Consequently, some current progressive games provide a frustrating experience for the player.

Thus, there is a need to overcome the problems associated with the way progressive amounts are represented to a player. The present invention is directed to satisfying this and other needs.

SUMMARY OF THE INVENTION

A gaming terminal for playing a wagering game includes a player-input device, a display, and a progressive display region. The wagering game includes at least one progressive jackpot that is funded by a portion of a wager input received in a player-input device. In response to receiving the wager input the display shows at least one randomly-selected outcome of a plurality of outcomes. The progressive display region includes a dynamic representation of the progressive jackpot, wherein the size of the dynamic representation changes in real-time according to changes occurring in the progressive jackpot.

In another aspect of the present invention, a method of conducting a wagering game includes selecting at least one randomly-selected outcome, from a plurality of outcomes, in response to receiving a wager input. The wagering game includes at least one progressive jackpot that is represented by a dynamic element having an original size. The method further includes modifying the original size of the dynamic element in real-time in accordance to changes in the progressive jackpot.

In an alternative aspect of the present invention, a method for playing a wagering game includes displaying a plurality of symbols for playing a basic game and indicating, via the symbols, a randomly-selected outcome from a plurality of outcomes of the basic game. The method further includes displaying a progressive game when the randomly-selected outcome is a predetermined outcome. The progressive game includes a progressive jackpot that is presented by a physical representation. The physical representation is dynamic and includes at least one nonnumeric element. The size of the nonnumeric element changes in real-time according to changes in the progressive jackpot.

In an alternative aspect of the present invention, a gaming terminal for playing a wagering game includes a player-input device, a display, and a progressive display region. The wagering game includes at least one progressive jackpot that is funded by a portion of a wager input received in a player-input device. In response to receiving the wager input the display shows at least one randomly-selected outcome of a plurality of outcomes. The progressive display region includes a dynamic representation of the progressive jackpot, wherein the dynamic representation includes a texture-mapped symbol.

In an alternative aspect of the present invention, a method of conducting a wagering game includes selecting at least one randomly-selected outcome, from a plurality of outcomes, in response to receiving a wager input. The wagering game includes at least one progressive jackpot that is represented by a dynamic element. The method includes texture-mapping a symbol on the dynamic element.

The above summary of the present invention is not intended to represent each embodiment, or every aspect, of the present invention. Additional features and benefits of the present invention are apparent from the detailed description, figures, and claims set forth below.

BRIEF DESCRIPTION OF THE FIGURES

The foregoing and other advantages of the invention will become apparent upon reading the following detailed description and upon reference to the drawings.

Figure 1:
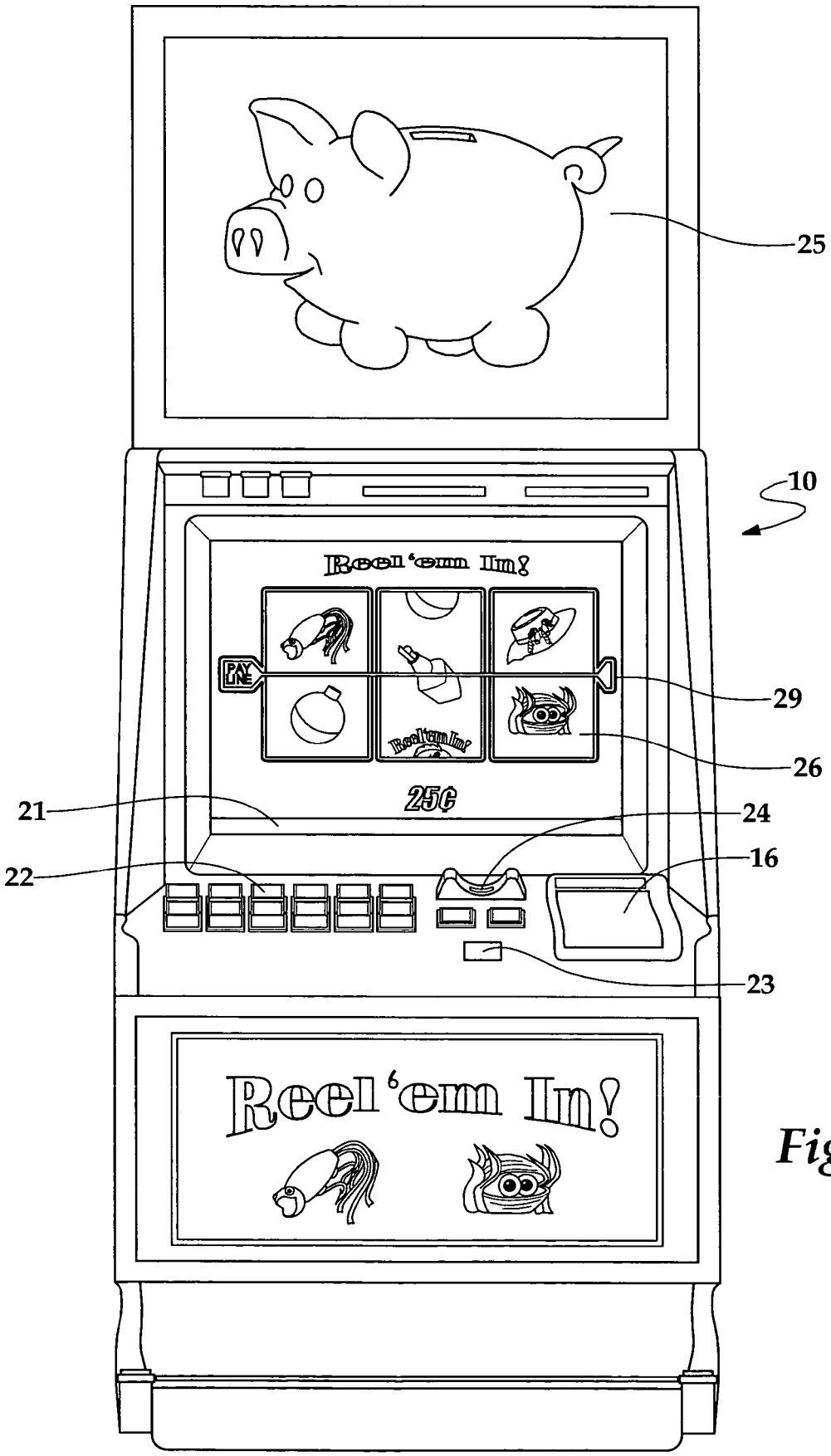
FIG. 1 illustrates a gaming terminal that is useful for operating an enhanced progressive game in accordance with the present invention.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Referring to FIG. 1, a gaming terminal 10 is used in gaming establishments such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play a video casino game, such as blackjack, slots, keno, poker, etc.

The gaming terminal 10 includes input devices, such as a wager acceptor 16, a touch screen 21, a push-button panel 22, and a player-identification card reader 24. For outputs, the gaming terminal 10 includes a main display 26 for displaying information about the basic wagering game. The main display 26 can also display information about a bonus wagering game and a progressive wagering game. The gaming terminal 10 also includes a secondary game display 25 for displaying a bonus wagering game or award amounts for a progressive game. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The wager acceptor 16 may include a coin slot acceptor or a note acceptor to input value to the gaming terminal 10. Or, the wager acceptor 16 may include a card-reading device for reading a card that has a recorded monetary value with which it is associated. The card may also authorize access to a central account, which can transfer money to the gaming terminal 10.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The operation of the basic wagering game is displayed to the player on the main display 26. The main display 26 can also display a bonus game associated with the basic wagering game. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome.

A payout mechanism 23 performs the reverse functions of the wager acceptor 16. For example, the payout mechanism 23 may include a coin dispenser or a note dispenser to output value from the gaming terminal 10. Also, the payout mechanism 23 may be adapted to receive a card that authorizes the gaming terminal to transfer credits from the gaming terminal 10 to a central account.

The player-identification card reader 24 allows for the identification of a player by reading a card with information indicating his or her true identity. Currently, the identification is used by casinos for rewarding certain players with complimentary services or special offers. For example, a player may be enrolled in the gaming establishment's player's club and may be awarded certain complimentary services as that player collects points in his or her player-tracking account. The player inserts his or her card into the player-identification card reader 24, which allows the casino's computers to register that player's wagering at the gaming terminal 10.

A player begins play of the basic wagering game by inserting a wager input into the wager input accepter 16 of the gaming terminal 10. A player can select play by either using the touch screen 21 or the push-button panel 22. The basic game consists of a plurality of symbols on reels 28 that are displayed along at least one payline 29, yielding a plurality of outcomes of the basic game. Such outcomes are randomly selected in response to the wagering input by the player. One of the plurality of randomly selected outcomes is a start-bonus outcome, which includes any variations of symbols and which triggers a bonus game.

Figure 2:
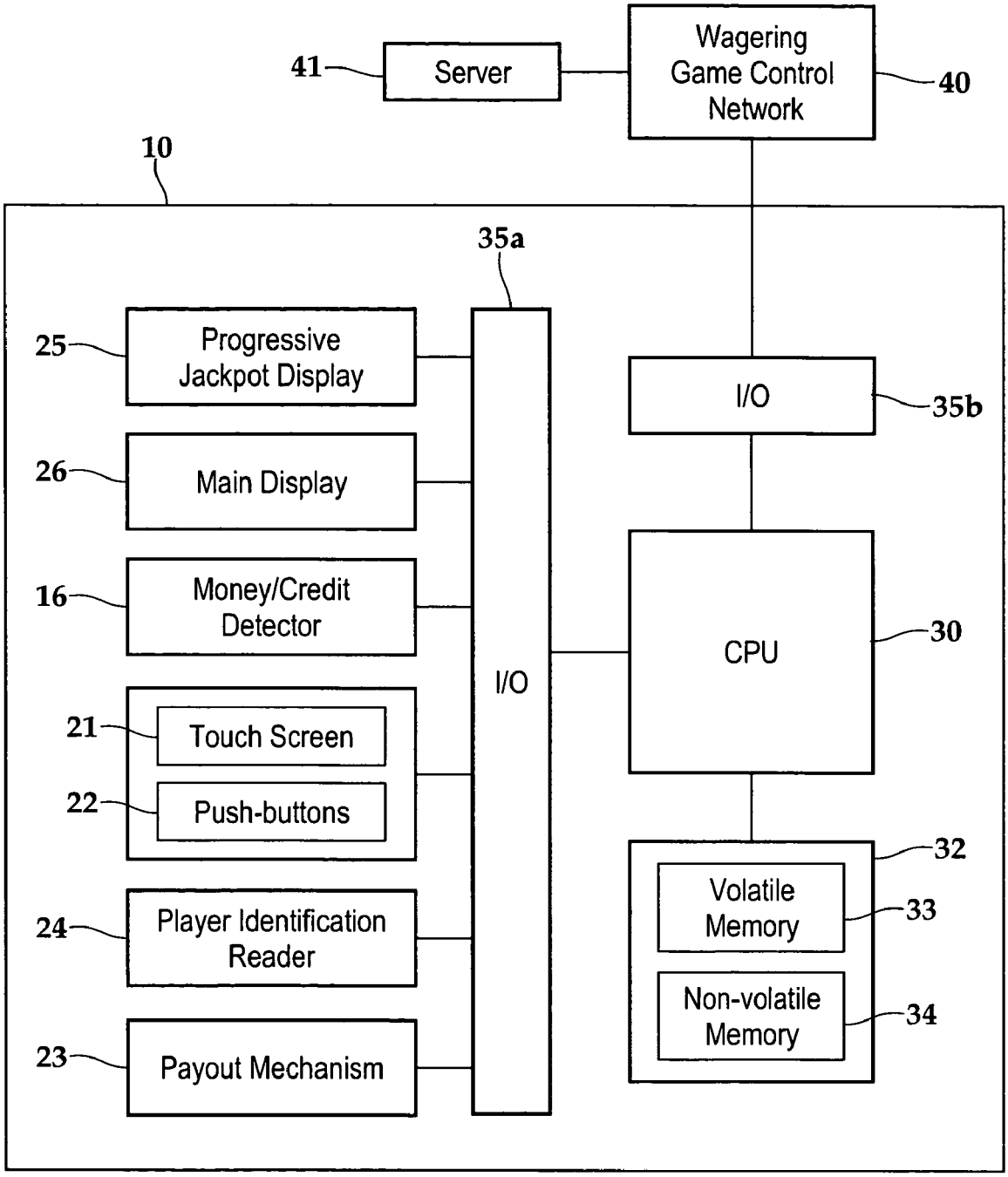
FIG. 2 illustrates a control system that is used in conjunction with the gaming terminal of FIG. 1.

As shown in FIG. 2, the various components of the gaming terminal 10 are controlled by a central processing unit (CPU) 30, also referred to as a processor (such as a microprocessor or microcontroller). To provide the gaming functions, the CPU 30 executes a game program. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 40 having control circuitry and memory devices. The gaming terminal 10 often has multiple serial ports, each port dedicated to providing data to a specific host computer system that performs a specific function (e.g., accounting system, player-tracking system, progressive game control system, etc). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 40). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 40.

In an alternative embodiment, the wagering game control network 40 is a progressive game network 40. A plurality of gaming terminals 10 are linked together, via the progressive game network 40, for allowing a number of players to contribute to one or more common progressive jackpots. For example, a percentage of the wager input from two players, each of which is conducting a wagering game on a different one of the gaming terminals 10, is used towards a common progressive jackpot. The common progressive jackpot can be shown on a progressive game signage that is located above the plurality of gaming terminals 10. The progressive game signage can be a video display or a mechanical representation.

Figure 3A:
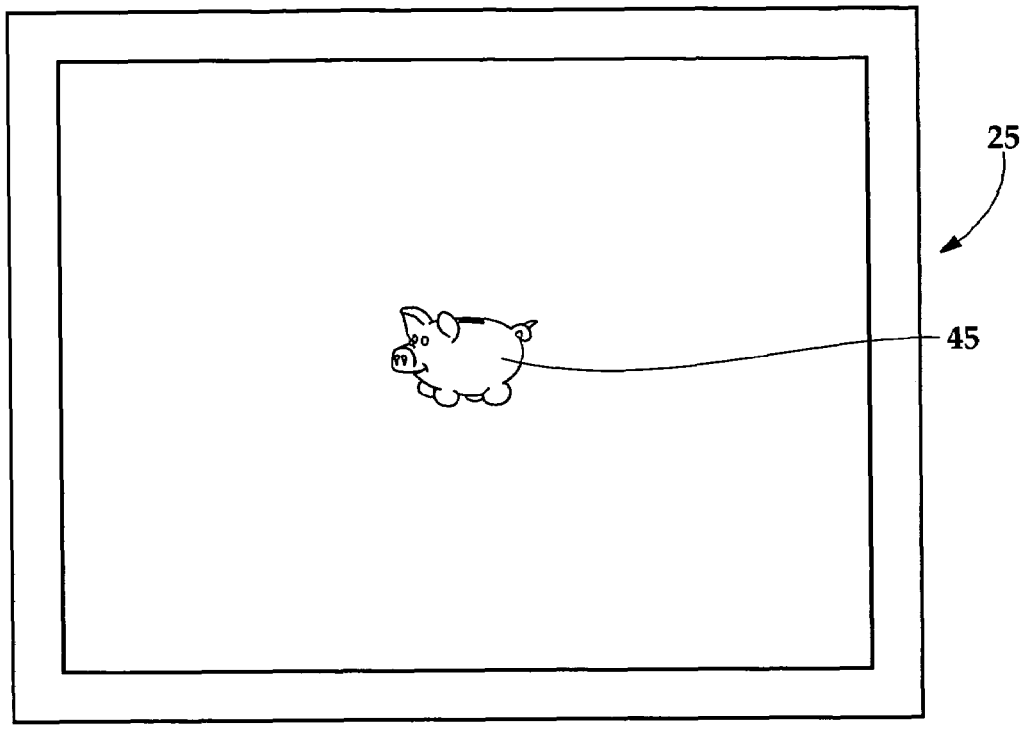
FIGS. 3A and 3B illustrate a main display showing a plurality of spinning reels and a secondary display including a dynamic representation of a progressive jackpot.
Figure 3B:
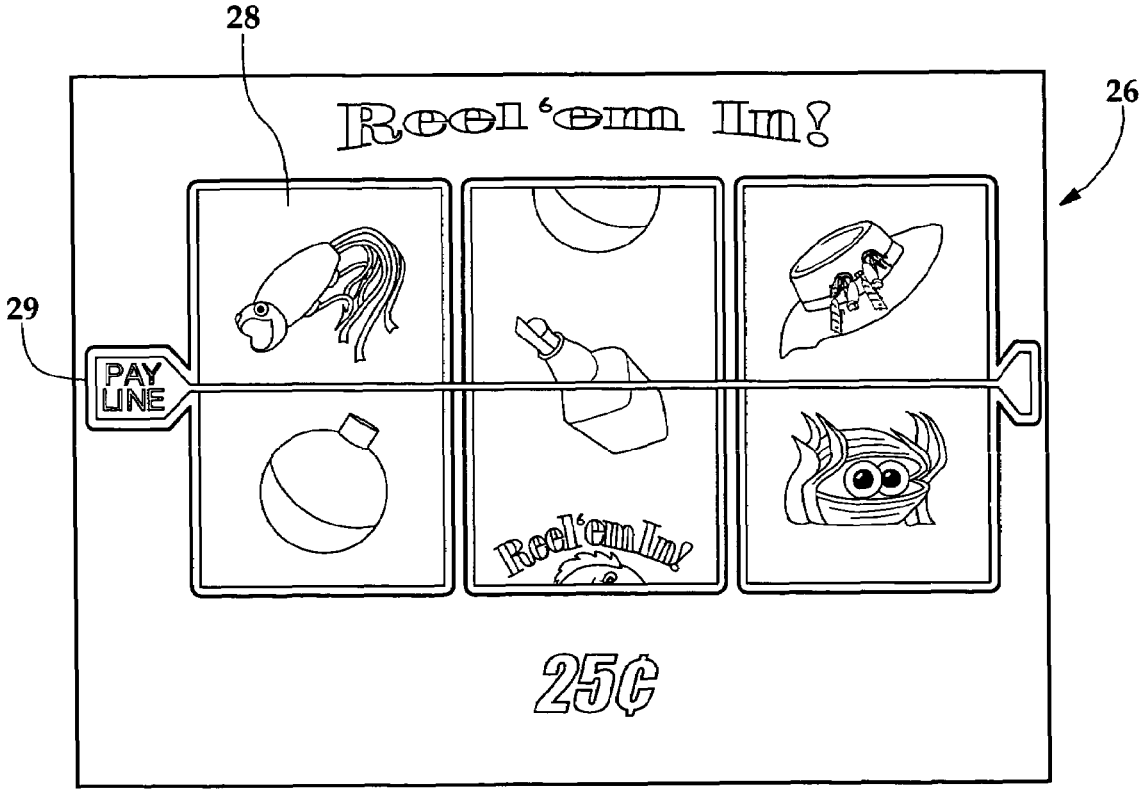

Referring to FIGS. 3A and 3B, the secondary display 25 includes a dynamic representation 45, which is a physical representation of a progressive jackpot. The dynamic representation 45, shown as a piggybank, is updated in real-time according to changes occurring in the corresponding progressive jackpot. Specifically, the size of the piggybank image increases or decreases as the amount of the corresponding progressive jackpot increases or decreases.

After a game outcome has been selected in the main display 26, a percentage of the player's wager is added to the progressive jackpot. Thus, after the reels 28 have stopped spinning and three symbols have been aligned along the payline 29, a percentage of the player's wager is added to the progressive jackpot regardless of whether the selected symbols form a winning combination. As the added percentage of credits is added to the progressive jackpot, the piggybank 45 increases in real-time to visually stimulate the player's awareness of the increasing progressive jackpot. In other words, the piggybank 45 inflates or deflates, similar to a balloon, to visually track the changes in the progressive jackpot as the changes are occurring.

Figure 4A:
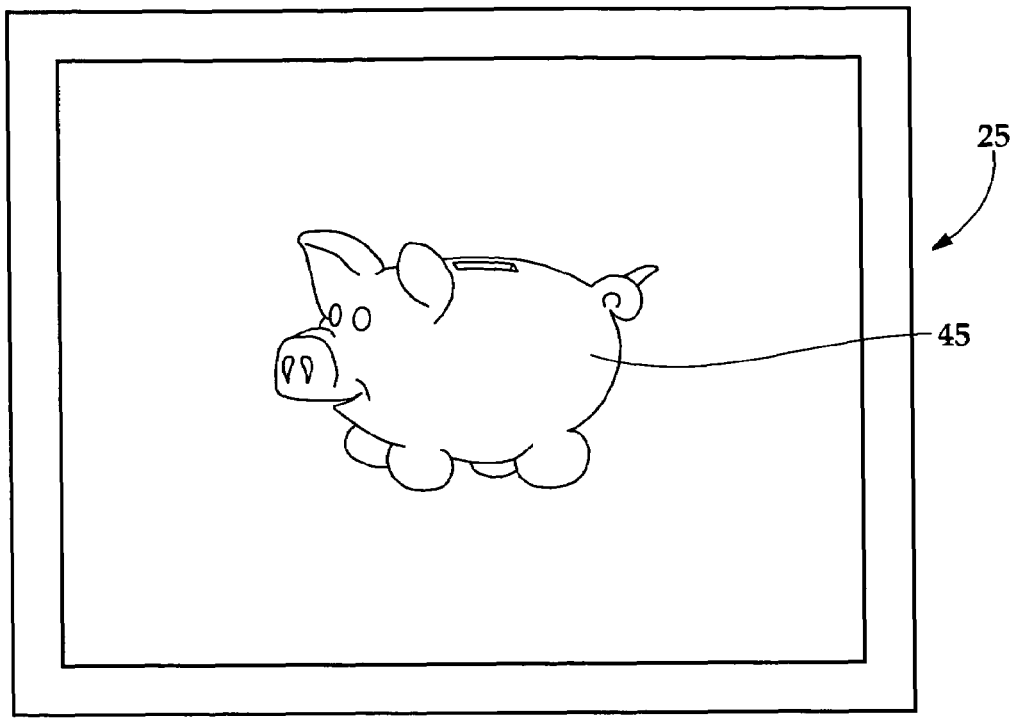
FIGS. 4A and 4B illustrate the displays of FIGS. 3A and 3B, wherein the dynamic representation has a larger size.
Figure 4B:
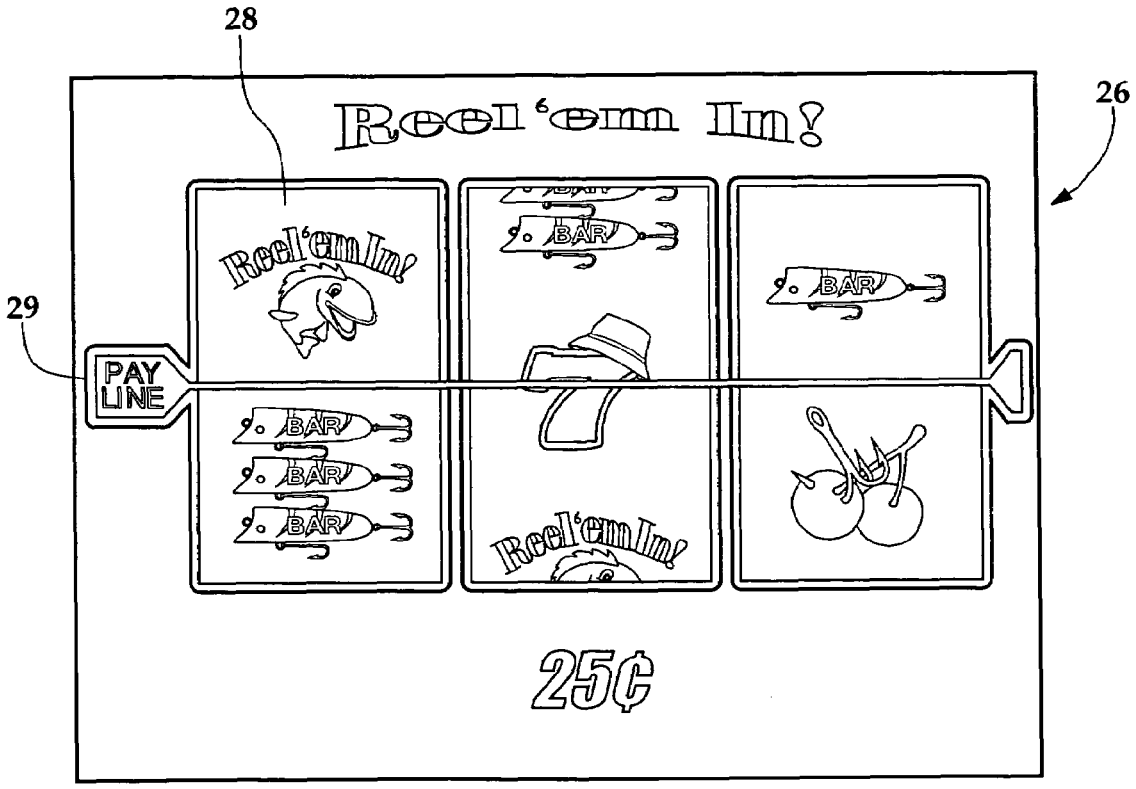

In FIGS. 4A and 4B, the piggybank 45 is shown after an additional game outcome has been selected. The piggybank 45 is shown having a much larger size than the size shown in FIG. 3A because more credits have been added to the progressive jackpot. Had the progressive jackpot decreased in value, such as when someone wins the progressive jackpot, the size of the piggybank 45 would decrease in size to show the that the progressive jackpot is smaller than it had been.

Although the dynamic representation 45 has been described so far as a video image on the secondary display 25, the dynamic representation 45 can also be a mechanical device or a combination of a mechanical device and a vide image. For example, the dynamic representation 45 can be a mechanical piggybank that changes its physical size according to input corresponding to the fluctuations in the corresponding progressive jackpot. In another example, the dynamic representation 45 can be a mechanical device and a video image that act in cooperation to show the progressive jackpot's fluctuations.

Any type of symbol can be used to depict the dynamic representation 45. For example, the dynamic representation 45 can be a pig, a bag of coins, a pile of money, a blowfish, etc. Each symbol can have its own special effects when the progressive jackpot is won. For example, using a pig symbol, the winning of a progressive jackpot can be represented by having a big pig explode into a plurality of bacon bits. Then, the bacon bits can slowly disappear as a small pig returns to represent a small progressive jackpot.

The dynamic representation 45 can include both nonnumeric and numeric symbols. In one preferred embodiment the dynamic representation 45 includes only a nonnumeric symbol. Although progressive amounts have been shown in the past using a number meter, which shows the amount of the progressive jackpot numerically, previous progressive jackpots have not been displayed using dynamic representations. Previous representations include only static images that do not vary in size. A problem with using a static number meter is that it does not provide enough visual stimulation. In contrast, the present invention provides a player with the perception that he or she may win a continuously-growing progressive jackpot. The static number meter changes numbers, to show the amount of the progressive jackpot, but does not change the size of the meter. The problem with having the numbers changes, but not the actual size of the numbers, is that after a certain time period the numbers tend to lose any meaning. Even though the progressive jackpot is shown to increase, presenting the increase by simply showing the change in the amount is not persuasive enough to make the player excited about winning the jackpot. The current invention adds a new dimension because the change in size of the jackpot representation provides a powerful visual stimulant when playing for a progressive jackpot.

In addition to a nonnumeric symbol, the dynamic representation 45 can optionally include a numeric symbol that is texture-mapped on said nonnumeric symbol. At least one of the nonnumeric and the numeric symbols changes in size in accordance to changes in the progressive jackpot. Optionally, the numeric symbol is a three-dimensional symbol.

The dynamic representation 45 can be used to represent a plurality of progressive jackpots. For example, the dynamic representation 45 can include a plurality of symbols, each symbol representing a distinct progressive jackpot. Any combination of symbols and progressive jackpots can be used. For example, two symbols can be used to display a single progressive jackpot or one symbol can be used to display two progressive jackpots.

The dynamic representation 45 can optionally represent the probability of winning a progressive jackpot. Thus, the size of the dynamic representation 45 can change in response to two factors: a) the amount of the progressive jackpot, and b) the probability of winning the progressive jackpot. The two factors can be combined so that a change in size corresponds to both factors. For example, a small jackpot having a small probability of being won would be represented by a dynamic representation 45 having a small size. In contrast, a large jackpot having a great probability of being won would be represented by a dynamic representation 45 having a large size. Alternatively, two distinct symbols can be used for each factor. For example, a first symbol can be used to represent the change in the progressive amount, and a second symbol can be used to represent the change in the probability of winning the progressive jackpot.

Alternatively, in addition to the value of a progressive jackpot being textured on the dynamic representation 45, the name of the respective progressive jackpot can also be textured on the dynamic representation 45. For example the titles "Mega-Jackpot," "Super Jackpot," and "Jackpot" can be texture-mapped on the dynamic representation 45. Thus, if the wagering game can result in winning a plurality of jackpots, the player can easily identify a specific jackpot from the plurality of jackpots.

Figure 5:
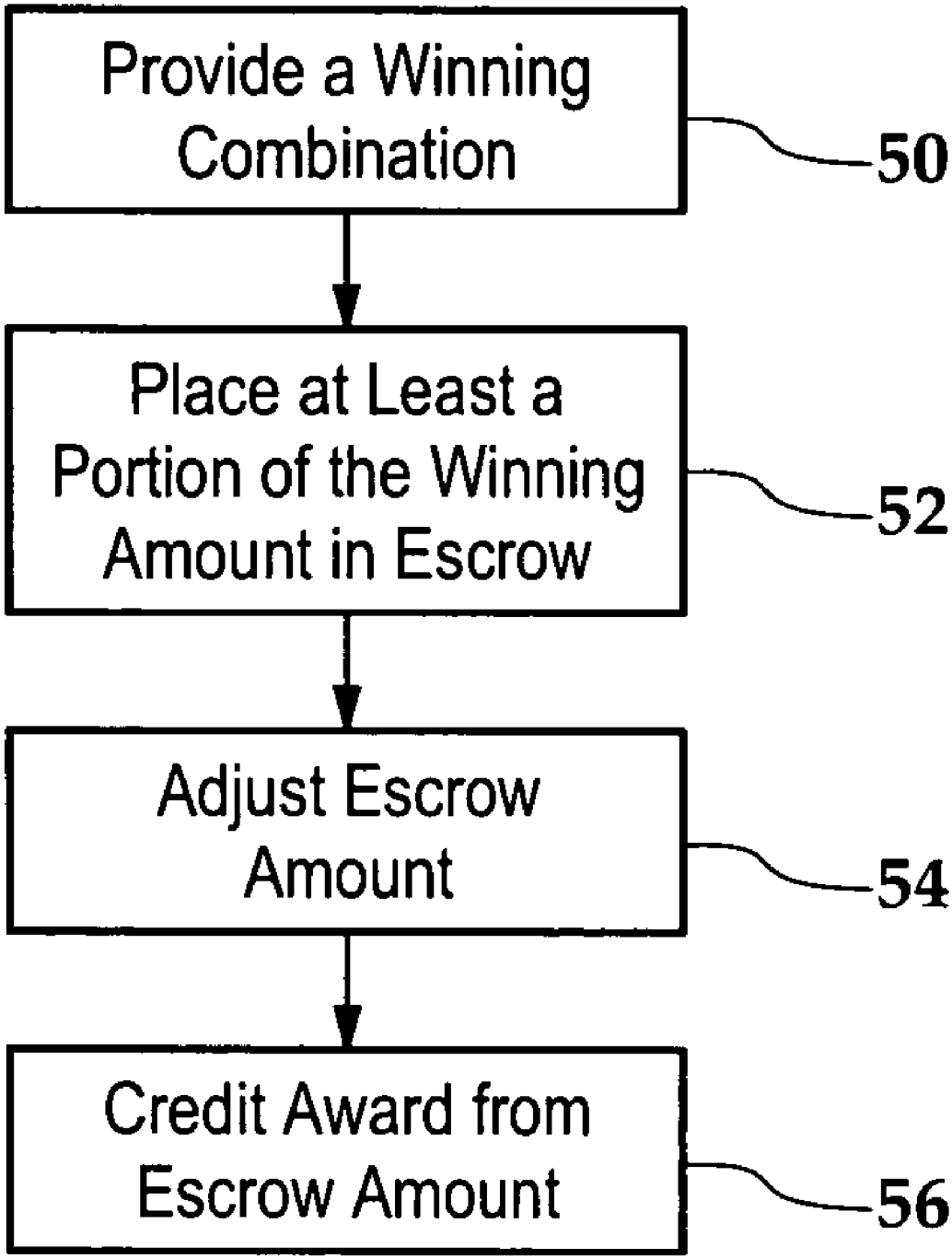
FIG. 5. illustrates a flowchart of a wagering game according to another embodiment of the present invention.

Referring to FIG. 5, a flowchart shows a general example of a wagering game having a type of progressive jackpot. The jackpot in this game increases when a winning combination is selected. At step 50 a winning combination has been provided in response to a wager input from a player. Then, at step 52 at least a portion of the corresponding winning amount is placed in escrow. Optionally, the entire winning amount is placed in escrow. Thus, the player does not receive at least a portion of the winnings.

At step 54, the escrow amount is adjusted if predetermined conditions are met. For example, the escrow amount can increase linearly with the period of time that the escrow amount is kept in escrow, i.e., similar to money accruing interest in a savings account. Alternatively, the escrow amount can increase if a number of winning combinations are selected within a predetermined period of time or if a number of winning combinations are selected within a predetermined number of spins. Any other well-known gaming conditions can be applied to the escrow amount while the credits are held in escrow. For example, the credits can double each time a multiplier symbol is selected in a game outcome, the credits can increase each time a winning outcome is selected in a bonus game, the credits can decrease each time a losing symbol is selected in a game outcome, etc.

At step 56 the credits that have accumulated in escrow are awarded to the player. For example, if the credits are kept in escrow for a limited period of time, the credits are awarded to the player when the time period expires. To the extent that the escrow amount is determined by contributions from one or more players, the escrow amount can be perceived to be a progressive amount. Thus, the escrow amount can be represented by a dynamic representation as described above regarding progressive jackpots, in reference to FIGS. 3A-4B.

Figure 6A:
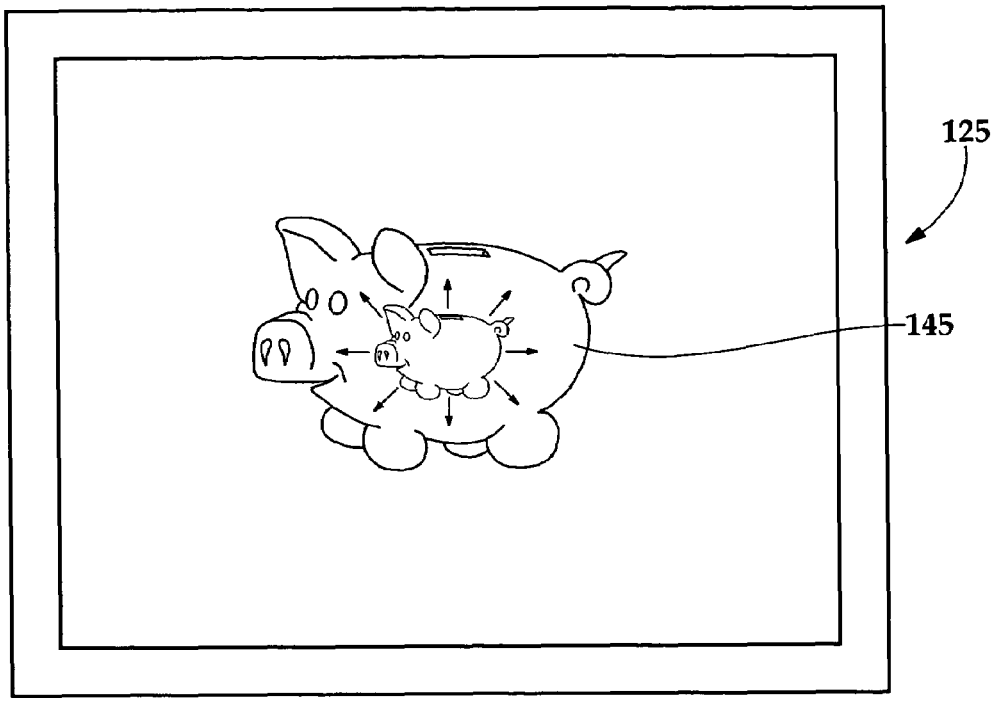
FIGS. 6A and 6B illustrate a main display showing a winning combination and a secondary display showing a dynamic representation of a progressive jackpot, according to another embodiment of the present invention.
Figure 6B:
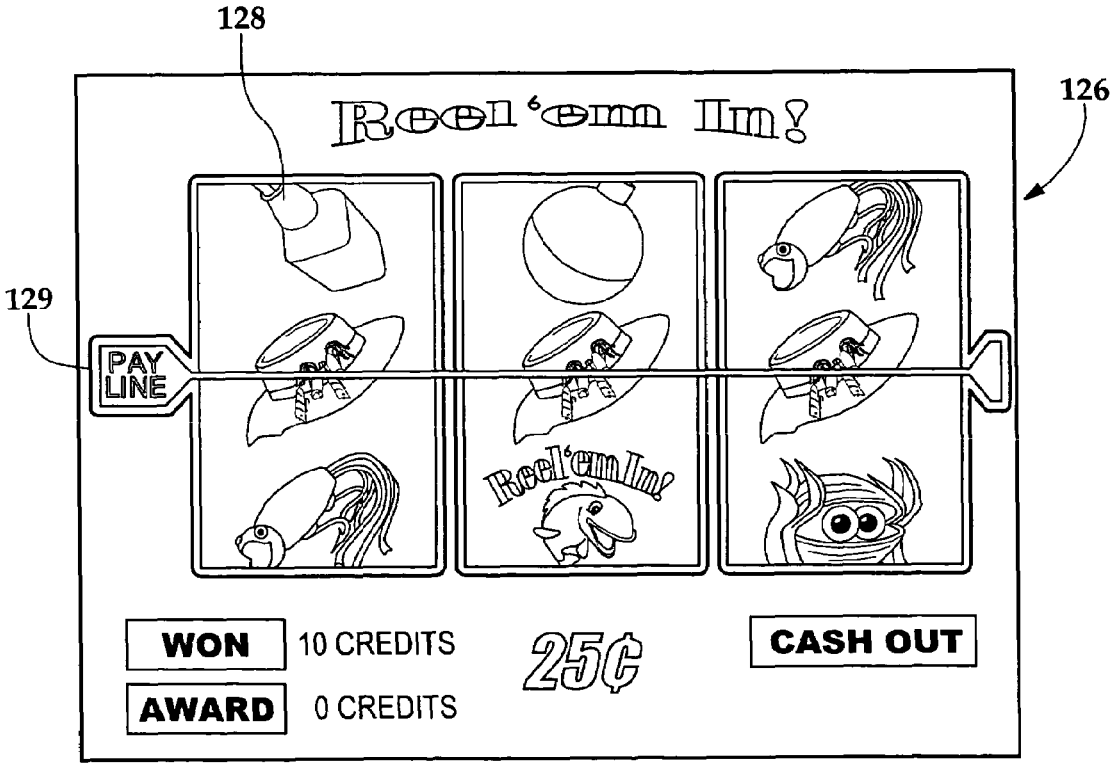

Referring now to FIGS. 6A-8B, a specific example of the wagering game described in reference to FIG. 5 will be described. In FIGS. 6A and 6B, a winning combination has been selected in a main display 126 by spinning and stopping reels 128 to align three hat symbols along an active payline 129. Although at the bottom of the main display 126 a menu shows that ten credits are the corresponding winnings, zero credits are awarded to the player.

A secondary display 125, which includes a dynamic representation 145 for an escrow amount, is located above the main display 126. The dynamic representation 145 is a symbol of a piggybank. The piggybank 145 is a dynamic video symbol that increase in response to changes in the amount placed in escrow. As described above, the changes to the size of the piggybank 145 occur in real-time.

Figure 7A:
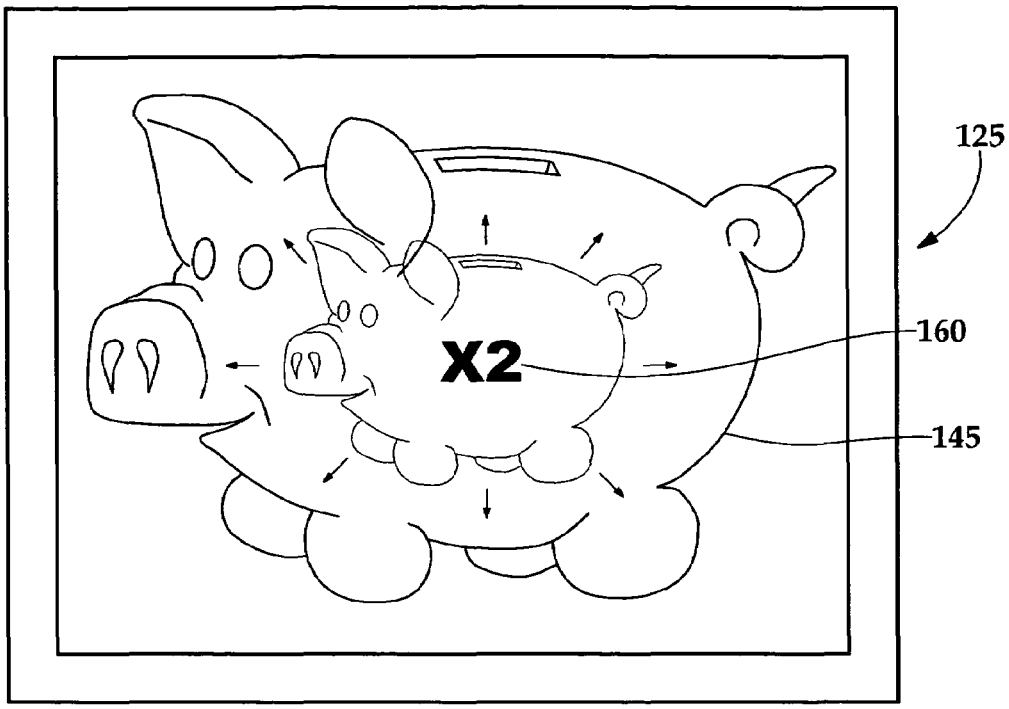
FIGS. 7A and 7B illustrate the displays of FIGS. 6A and 6B, wherein the dynamic representation of FIG. 6A has a larger size.
Figure 7B:
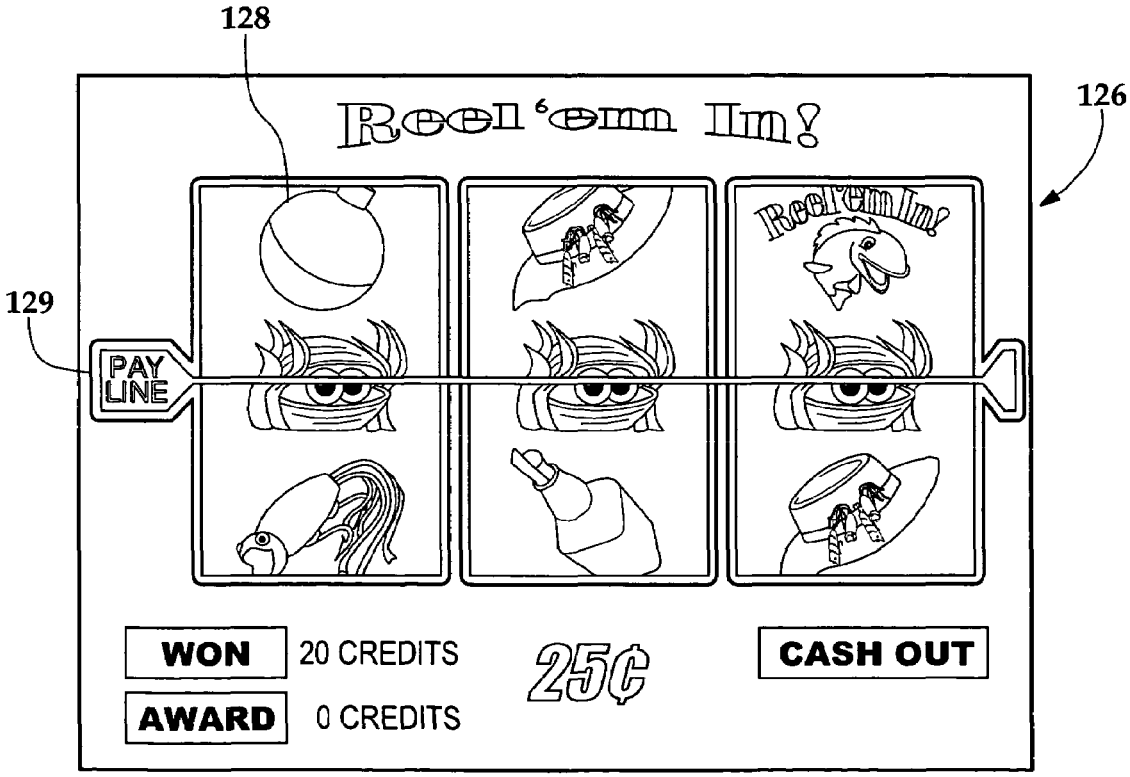

In FIGS. 7A and 7B another winning combination has been selected, which consists of three shell symbols aligned along the payline 129. Although twenty winning credits correspond to the winning combination, zero credits are awarded to the player. The piggybank 145 increases in size in proportion to the number of credits that have been placed in escrow. Thus, the piggybank 145 has tripled in size in the last two selected outcomes. In addition, because two winning combinations have been selected in sequence a doubling symbol 160 is displayed on the secondary display 125. Consequently, the size of the piggybank 145 increases to six times its original size. The increase in size of the piggybank 145 is linear to the increase in size of the escrow amount, which has increased in size six times, to sixty credits, from the original amount of zero credits.

Figure 8A:
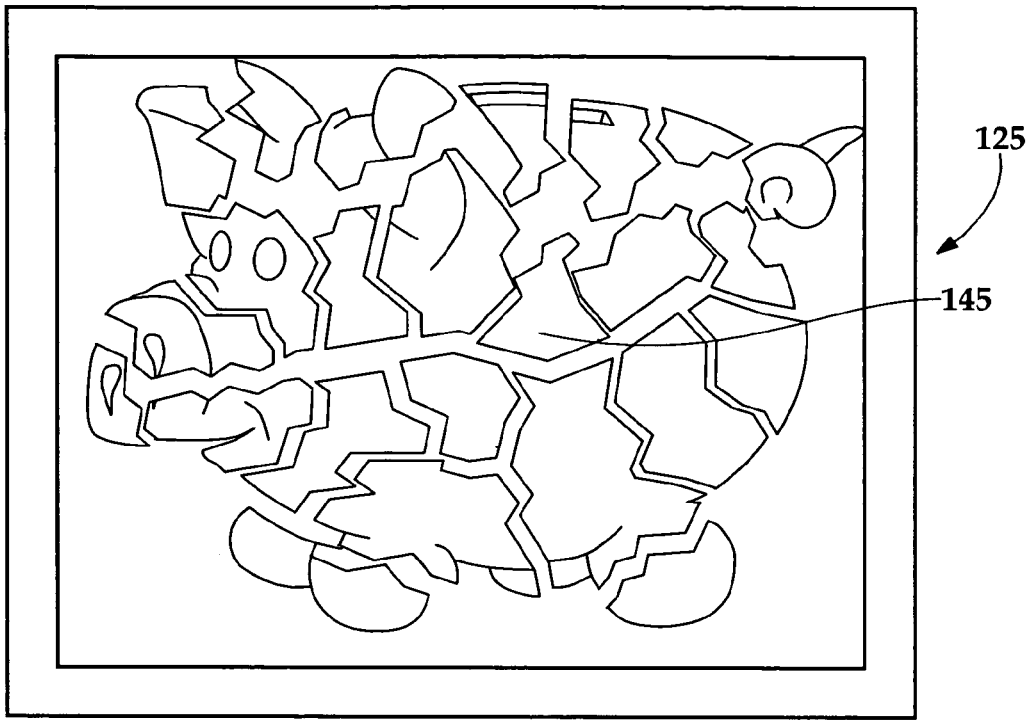
FIGS. 8A and 8B illustrate the displays of FIGS. 6A and 6B, wherein the dynamic representation is shown shattered.
Figure 8B:
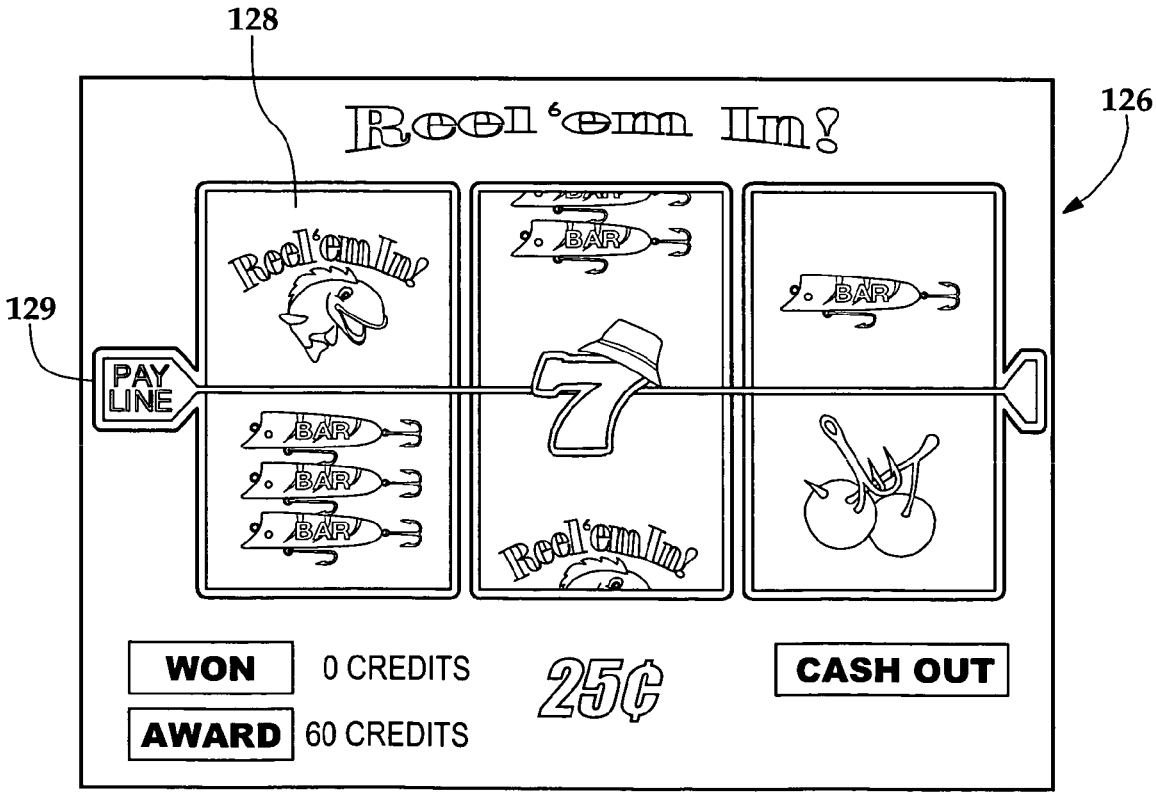

In FIGS. 8A and 8B a predetermined condition has been met and the piggybank 145 has shattered. A shattering effect can be shown as numerous pieces of the piggybank 145 fly across the screen of the display 125. At the bottom of the display 126 the player is notified that he or she has been awarded sixty credits. Optionally, the numerical value of the credits that are won during a selected winning combination are not displayed to the player, who has only the size of the piggybank 145 as an indication as to how many credits are placed in escrow. The fact that the player does not know the numerical value of the credits placed in escrow has the potential to create more excitement in the player.

Figure 9A:
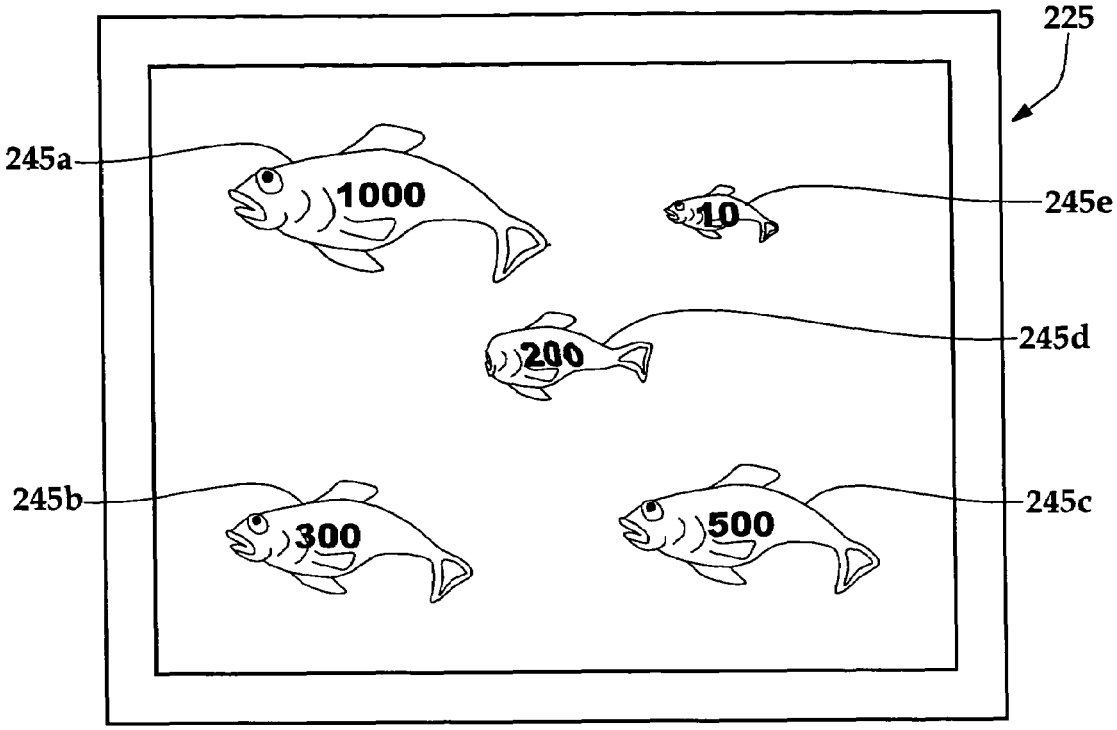
FIGS. 9A and 9B illustrate a main display showing a bonus-triggering outcome and a secondary display showing a plurality of dynamic representations of a progressive jackpot, according to another embodiment of the present invention.
Figure 9B:
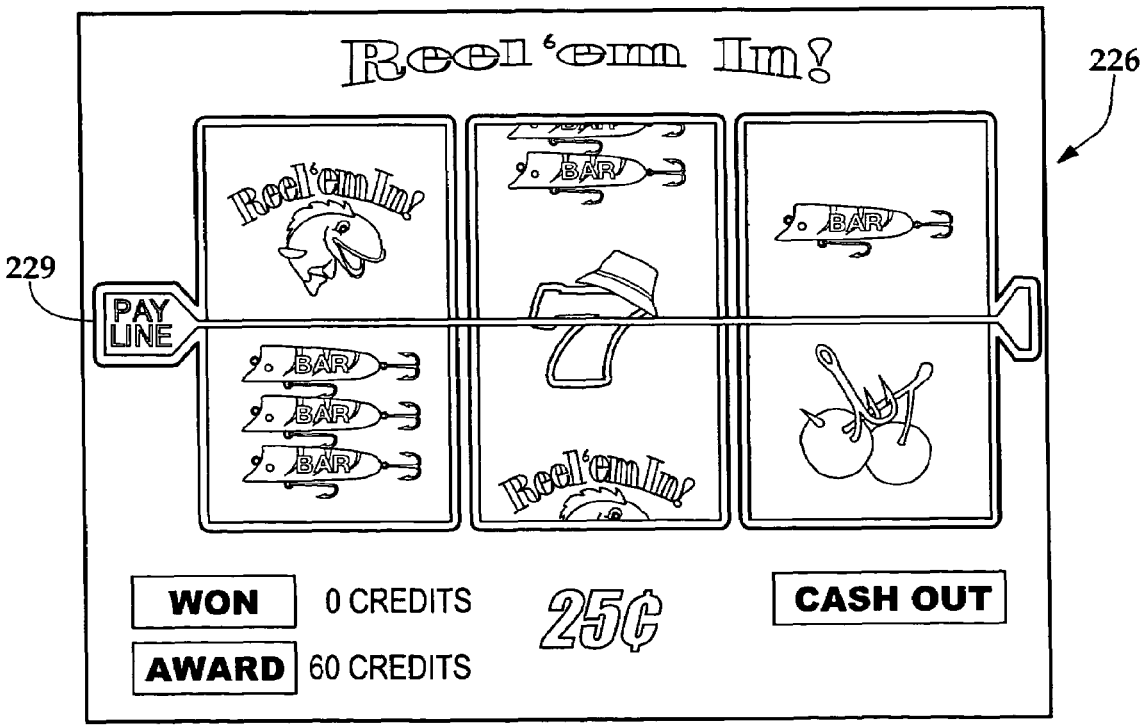

Referring to FIGS. 9A and 9B, a wagering game includes a main display 226 and a secondary display 225. The secondary display 225 includes a plurality of dynamic representations 245*a-e* (referred to collectively as dynamic representations 245), each of which represents a distinct progressive jackpot. Each of the dynamic representations 245*a-e* includes a nonnumeric symbol, e.g., a fish symbol, a numeric symbol, etc. The numeric symbol is texture-mapped on said nonnumeric symbol. Optionally, the numeric symbol is a three-dimensional symbol. Both the numeric symbol and the nonnumeric symbol are dynamic and updated in real-time in accordance with the amount of the respective progressive jackpot. Alternatively, the nonnumeric element can change in response to changes in the corresponding progressive amount and the numeric element can change in response to changes in the probability of winning the corresponding progressive amount.

A predetermined percentage of the amount wagered feeds each one of the progressive jackpots. In response to a player's wager, a progressive-game-triggering outcome has been randomly selected and is displayed in the main display 226. The progressive-game-triggering outcome consists of three "Reel'em In!" symbols aligned along an active payline 229. The player is now eligible to play for one or more of the progressive jackpots as shown in FIGS. 10A and 10B.

Figure 10A:
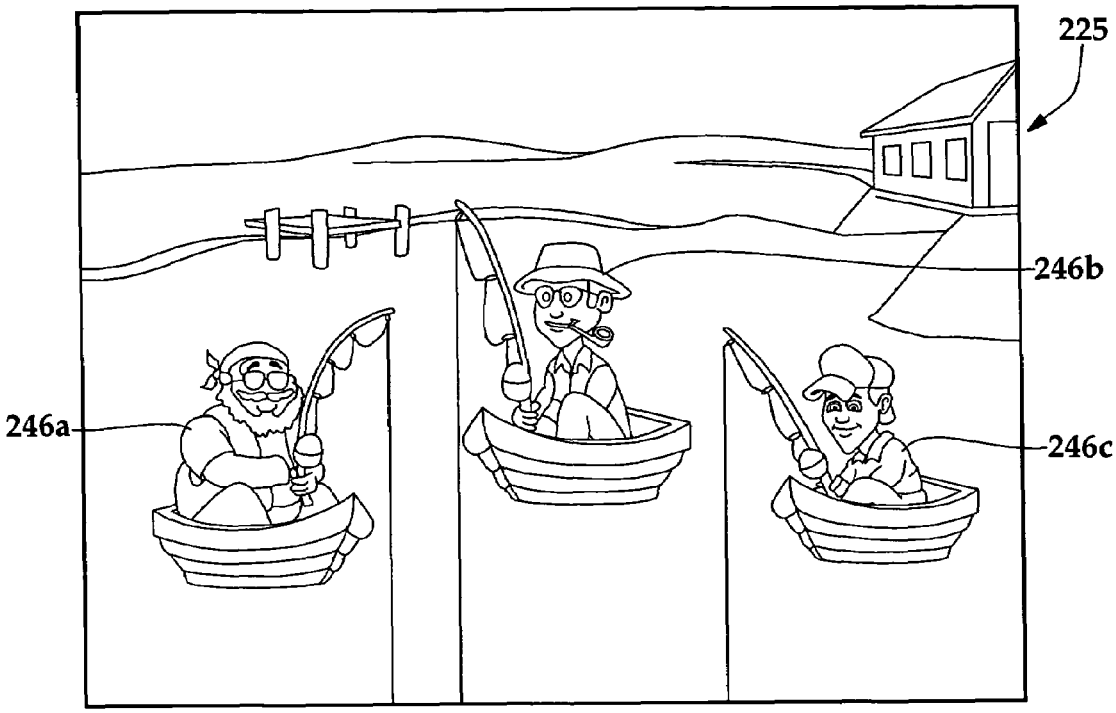
FIGS. 10A and 10B illustrate the main display of FIG. 9B showing the dynamic representations of the progressive jackpot and the secondary display of FIG. 9A showing a number of fishermen.
Figure 10B:
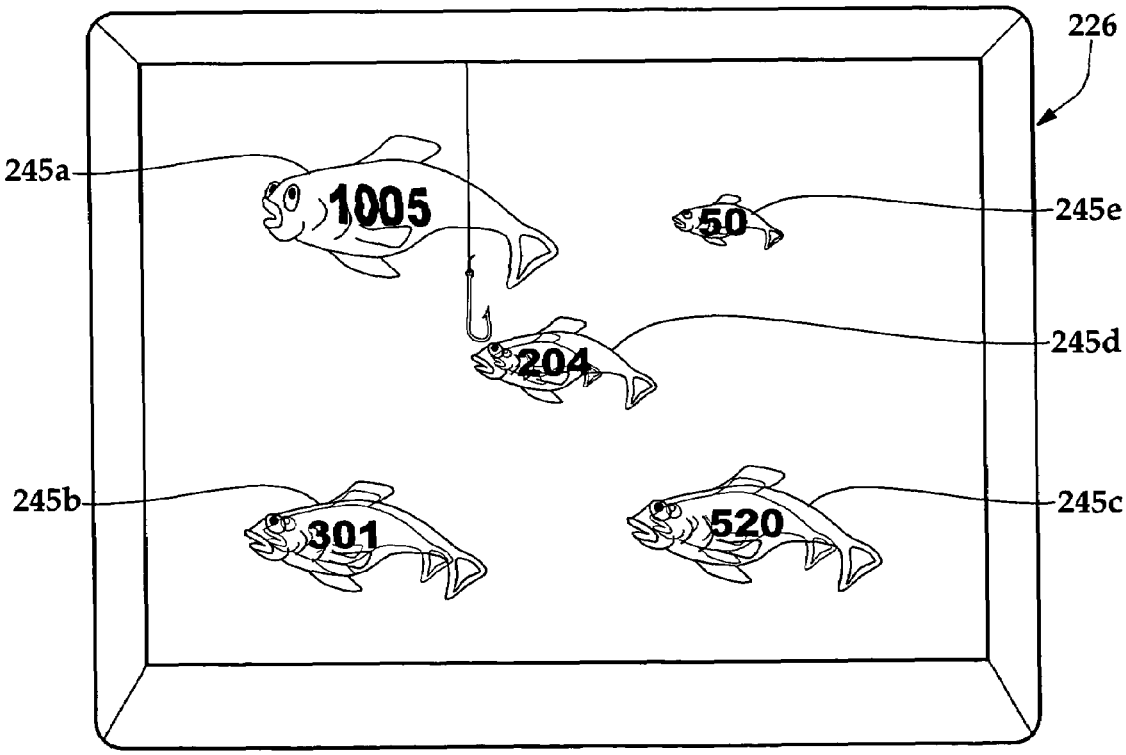

In FIGS. 10A and 10B, the fish 245 are displayed on the main display 226 and a number of fishermen 246*a-c* are displayed on the secondary display 225. A fishing line with a hook 247 is extended from the secondary display 225 to the main display 226 for each one of the fishermen 246*a-c*. Assuming that the progressive jackpots are fed by other gaming machines, the size of the dynamic representation 245 is continuously increasing. Further, the displaying of the numeric symbol makes the player aware of the exact value of a specific jackpot. Thus, the size of the fish symbol and the size of the numeric symbol are both changing according to the changes in the corresponding progressive jackpot.

Figure 11A:
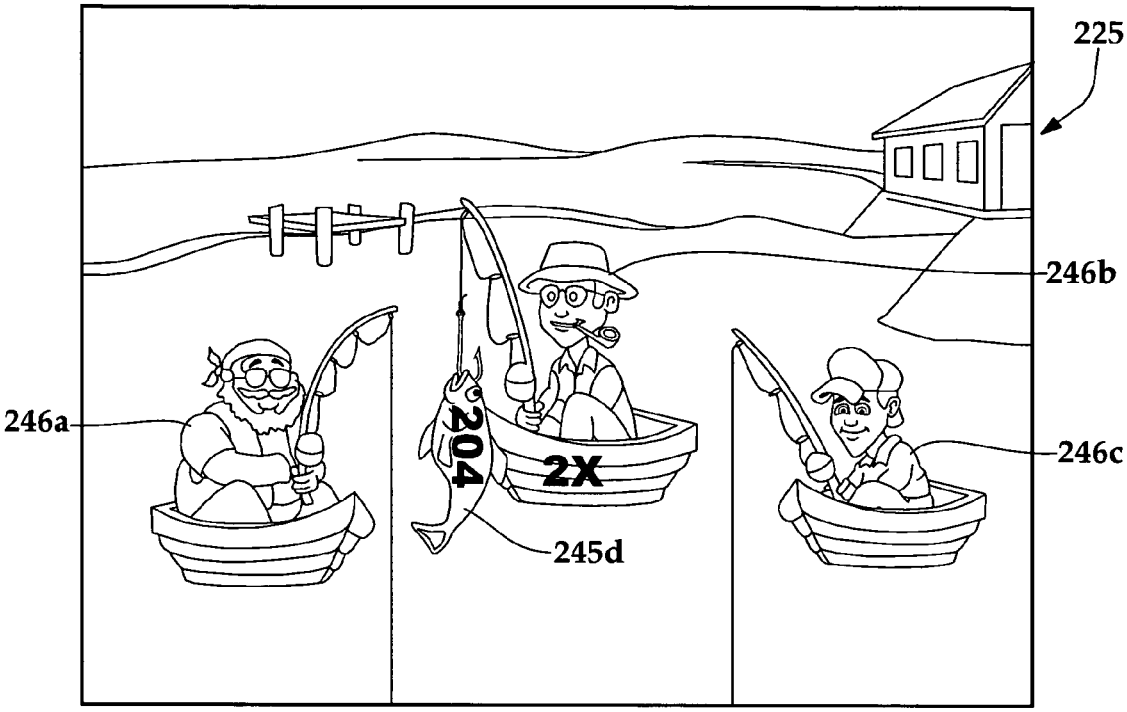
FIGS. 11A and 11B illustrate the selection of one of the progressive jackpots shown in FIG. 9A.
Figure 11B:
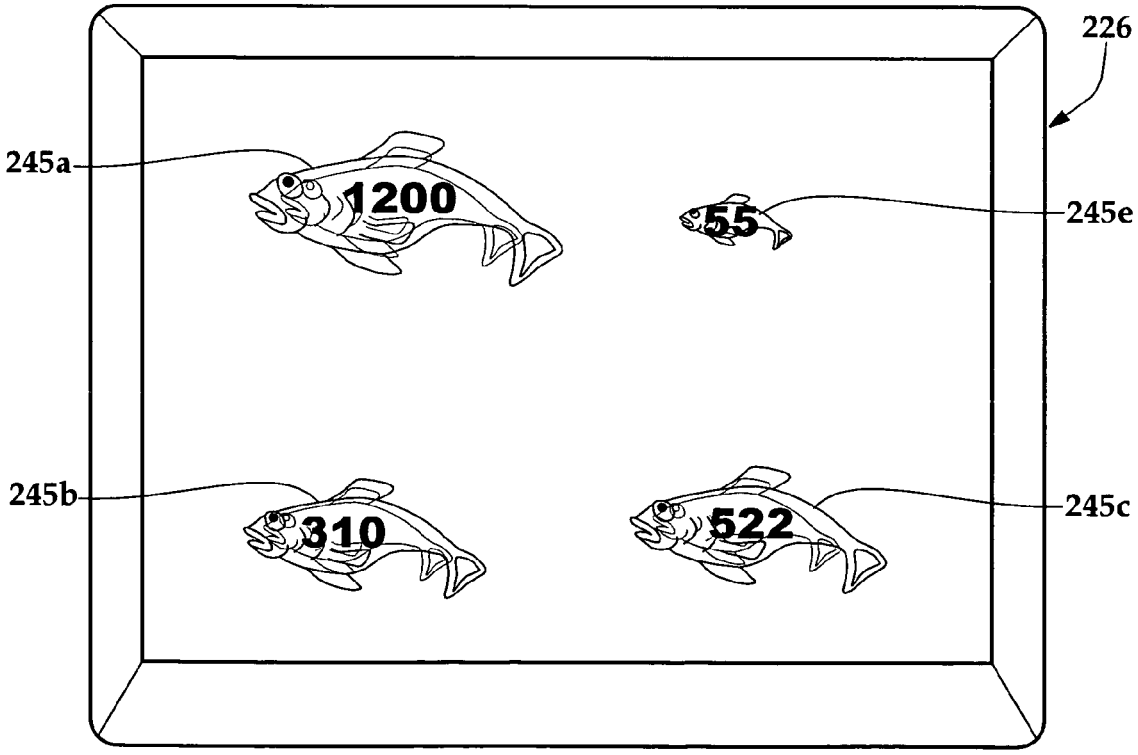
Figure 12A:
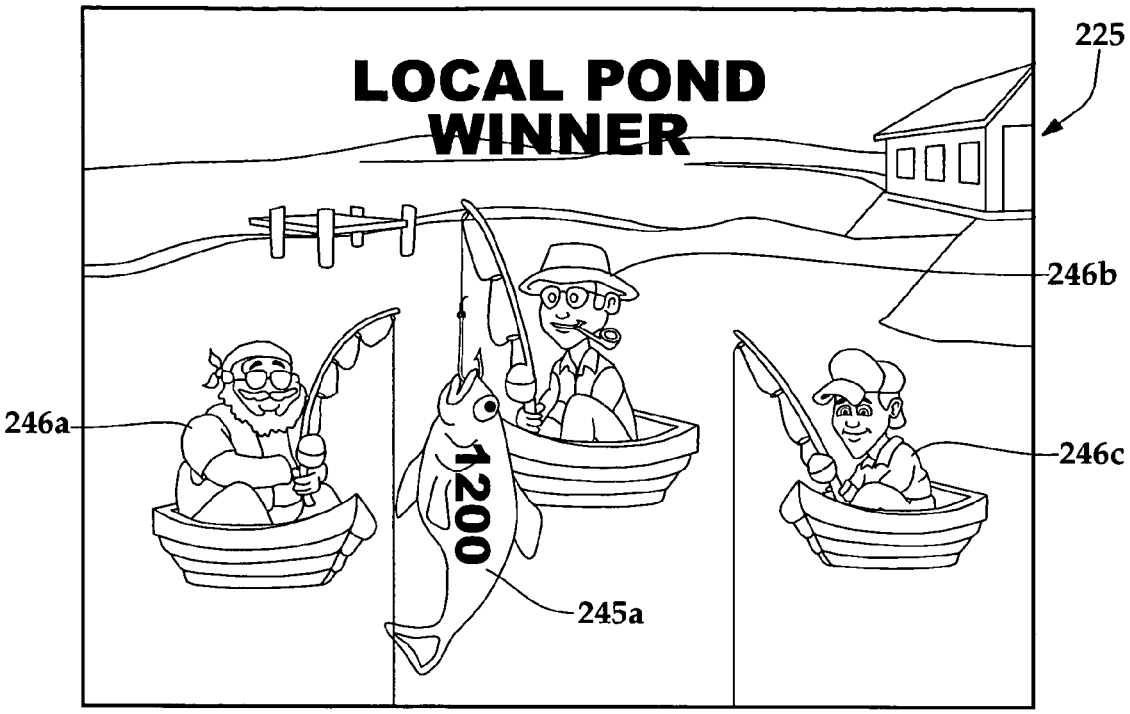
FIGS. 12A and 12B illustrate the selection of another one of the progressive jackpots shown in FIG. 9A.
Figure 12B:
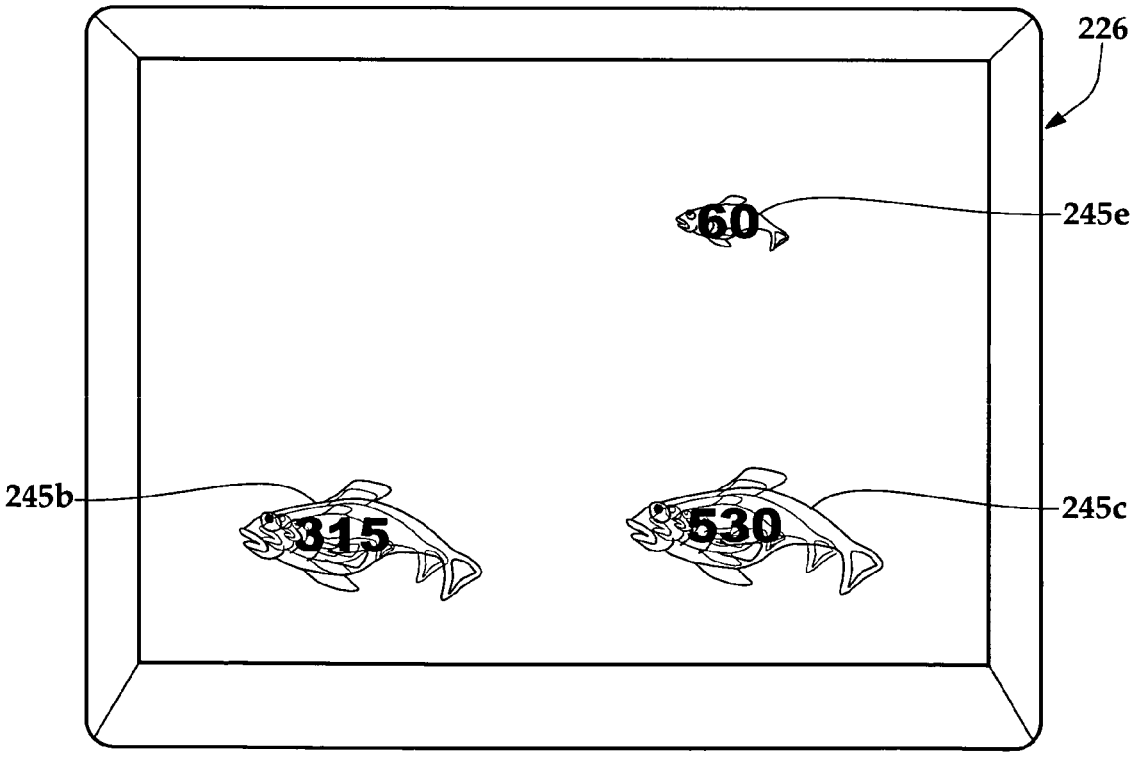

The player is prompted to select one of the fishermen 246*a-c*. Selecting the center fisherman 246*b*, as shown in FIGS. 11A and 11B, a relatively small fish 245*d* showing 204 credits is selected. On the secondary display 225, the player is notified via a "2×" symbol that he or she has two more casts left. The small fish 245*d* is now absent from the main display 226. In a second cast, which is not shown, the player has not won any progressive jackpots. In its last cast, shown in FIGS. 12A and 12B, the player has won the "Local Pond Winner." Optionally, the player can win an invitation to another fishing tournament, e.g., another bonus game, additional casts, or a chance to become a "Wide Area Progressive Winner." The "Local Pond Winner" is one of the largest progressive jackpots and is worth 1200 credits, as shown by the numeric symbol texture-mapped on the fish 245*a*. At the end of the bonus game, the player has won two of the five original progressive jackpots, and, consequently, two fish are now missing from the main display 226.

Alternatively, coins can be used to represent the portion of the wager inputs that find the progressive jackpots. For example, coins can fall from the secondary display 225 to the main display 226 and be swallowed by the fish 245. Bigger fish will swallow more coins, because they get a larger percentage of the wager inputs. For example, referring to FIGS. 9A and 9B, the biggest fish 245*a* will swallow two coins for every single coin that the next-sized fish 245*c* will swallow and ten coins for every single coin that the smallest fish 245*e* will swallow.

In an alternative embodiment, the location of the fish hook 247 can be used to represent the probability of each one of the fish 245 being caught. As described above, generally the size of a progressive jackpot is inversely proportional to the probability of winning the progressive jackpot. For example, it is more desirable to have the fish hook 247 located closer to the smallest fish 245*e*, which is the most likely to be caught, than to have the fish hook 247 located closer to the biggest fish 245*a*, which is the least likely to be caught. Locating the fish hook 247 near the fish 245 that is most likely to be caught has the effect of decreasing the frustration level of the player. For example, if the fish hook 247 is always located next to the biggest fish 245*a* but the player always ends up catching the smallest fish 245*e*, the player may feel deceived. Locating the fish hook 247 near the fish 245 that is most likely to be caught gives the player a more realistic perception of his or her odds in winning a particular progressive jackpot.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of conducting a wagering game, comprising:

receiving a wager input;

selecting at least one randomly-selected outcome from a plurality of outcomes in response to said receiving step for playing a wagering game, said wagering game including at least one progressive jackpot funded by a portion of said wager input;

representing a value of said progressive jackpot as a dynamic element in the form of at least one nonnumerical symbol having an original size, said dynamic element being able to change between said original size and another size; and modifying said original size of said nonnumerical symbol in real-time in accordance with changes in said value of said at least one progressive jackpot to visually represent said changes in said progressive jackpot in a nonnumerical manner as said changes are occurring.

2. The method of claim 1, wherein said modifying step includes linearly increasing said original size of said dynamic element in response to an increase in said at least one progressive jackpot.

3. The method of claim 1, wherein said representing step includes selecting said dynamic element from a group consisting of a mechanical device, a video image, and a combination of a mechanical device and a video image.

4. The method of claim 1, wherein said modifying step includes displaying in a video mode said dynamic element bursting into a plurality of pieces when said at least one progressive jackpot is won.

5. The method of claim 1, wherein said representing step includes texture-mapping one or more symbols on said dynamic element.

6. The method of claim 5, wherein said texture-mapping includes displaying a three-dimensional symbol.

7. The method of claim 1, wherein said representing step includes displaying said dynamic element as a first symbol and a second symbol, said modifying step modifying only one of said first symbol and said second symbol.

8. The method of claim 1, wherein said representing step includes displaying said dynamic element as a first symbol and a second symbol, said at least one progressive jackpot including a first progressive jackpot and a second progressive jackpot, said modifying step including changing a size of said first symbol in accordance to changes in said first progressive jackpot and a size of said second symbol in accordance to changes in said second progressive jackpot.

9. The method of claim 1, wherein said representing step includes displaying said dynamic element as a first symbol and a second symbol, said at least one progressive jackpot including a first progressive jackpot and a second progressive jackpot, said modifying step including changing each one of a size of said first symbol and a size of said second symbol in accordance to changes each one of said first progressive jackpot and said second progressive jackpot.

10. The method of claim 1, wherein said modifying step includes modifying said size of said dynamic element according to the probability of winning said at least one progressive jackpot.

11. The method of claim 1, wherein said representing step includes displaying said dynamic element as a first symbol and a second symbol, said modifying step includes modifying a size of said second symbol in real-time in accordance with changes in the probability of winning said at least one progressive jackpot.

12. A method for playing a wagering game, comprising:

(a) displaying a plurality of symbols for playing a basic game;

(b) indicating, via said symbols, a randomly-selected outcome from a plurality of outcomes of said basic game;

(c) displaying a progressive game when said randomly-selected outcome is a predetermined outcome, said progressive game including a progressive jackpot funded by a portion of said wager input;

(d) presenting a physical representation of a value of said progressive jackpot using a dynamic representation, said dynamic representation including at least one nonnumeric element having an original size, said nonumeric element being able to change between said original size and another size; and (e) changing the size of said nonnumeric element in real-time according to changes in said value of said progressive jackpot to visually represent said changes in said progressive jackpot in a nonnumerical manner as said changes are occurring.

13. The method of claim 12, wherein said presenting step includes texture-mapping another element on said nonnumeric element.

14. The method of claim 12, wherein said texture-mapping includes displaying said another element as a three-dimensional symbol.

15. The method of claim 12, further comprising changing the size of said dynamic representation in real-time according to changes in the probability of winning said progressive jackpot.

16. The method of claim 12, further comprising changing the size of said nonnumeric element in real-time according to changes in the probability of winning said progressive jackpot.

17. A method of conducting a wagering game, comprising:

receiving a wager input;

selecting at least one randomly-selected outcome from a plurality of outcomes in response to said receiving step for playing a wagering game, said wagering game including at least one progressive jackpot funded by a portion of said wager input;

representing a value of said progressive jackpot as a dynamic element in the form of at least one nonnumerical symbol having an original size, said dynamic element being able to change between said original size and another size in accordance with changes in said value of said progressive jackpot; and texture-mapping a symbol on said dynamic element.

18. The method of claim 17, wherein said texture-mapping includes displaying a three-dimensional symbol.

* * * * *